US005522298A

United States Patent [19]

Schaller et al.

[11] Patent Number: 5,522,298

[45] Date of Patent: Jun. 4, 1996

[54] TREMOLO ARM STABILIZER FOR ELECTRIC GUITAR

[76] Inventors: Helmut F. K. Schaller, Kuckucksweg 16, 8501 Feucht; René Schaller, Am alten Bahnhof 2, 90602 Pyrbaum, both of Germany

[21] Appl. No.: 417,080

[22] Filed: Apr. 5, 1995

[51] Int. Cl.[6] ..... G10D 3/00

[52] U.S. Cl. ..... 84/313

[58] Field of Search ..... 84/313, 307, 267

[56] References Cited

U.S. PATENT DOCUMENTS 5,311,804 5/1994 Wilkinson ..... 84/313

*Primary Examiner*—Steven L. Stephan
*Assistant Examiner*—Cassandra C. Spyron

[57] ABSTRACT

For an electric guitar equipped with a tremolo device, a stabilizer is provided to hold the horizontally extending portion of the actuating arm of the tremolo device in a fixed, but selectively adjustable, vertical position when the device is not being used by the player. The stabilizer is comprised of a retainer component adapted to be semi-permanently or permanently fixed to the top surface of the guitar body and a main component releasably connected with the retainer component to allow the main component to be removed from the retainer component to avoid interference between the stabilizer and a case when the guitar is placed into the case for storage or transport. The main component includes all of an adjustment device for selectively setting the vertical position at which the tremolo arm portion is held so that, barring any resetting of this adjustment device, the horizontally extending portion of the tremolo arm is held by the stabilizer in the same vertical position after reconnection of the main component with the retainer component as before the removal of the main component from the retainer component.

4 Claims, 3 Drawing Sheets

TREMOLO ARM STABILIZER FOR ELECTRIC GUITAR

FIELD OF THE INVENTION

This invention relates to electric guitars equipped with tremolo devices, and deals more particularly with an improved stabilizer for holding the actuating arm of a tremolo device when the actuating arm is not being used by the player of the associated guitar.

BACKGROUND OF THE INVENTION

Tremolo arm stabilizers of the type with which this invention is concerned are known and are shown, for example, in U.S. Pat. No. 4,697,493 and German Patent No. 4216506. In a tremolo device, the strings of the associated guitar are attached, at their bottom ends, to an anchor plate or other anchor member pivotally moveable relative to the guitar body about a pivot axis extending transversely of the strings. The tension of the strings tends to rotate the anchor member in one direction about the pivot axis and this tendency is counterbalanced by a spring acting between the anchor member and the guitar body urging the anchor member in the opposite direction about the pivot axis. An actuating arm is connected to the anchor member and is operable by the guitar player to allow the player to manually move the anchor member about the pivot axis to manually change the tension of the strings and to thereby change their pitches, allowing the player to achieve "tremolo" and other sound effects from the guitar. Usually the actuating arm is pivotally supported on the anchor member so as to be moveable between an active position at which it is located close to the strumming hand of the player and an inactive position at which it is remote from likely interference with the player's hand.

A tremolo stabilizer of the type with which the invention is concerned is used with a guitar to fixedly hold the actuating arm of a tremolo device when the arm is in its inactive position and, by such holding of the actuating arm, to prevent movement of the anchor member of the tremolo device about its pivot axis. That is, the stabilizer locks the actuating arm in a fixed position relative to the guitar body so that the strings are held in a stable condition.

Tremolo devices can be separated into two different types. One type is made up of those devices wherein the strings of the guitar stay in tune relative to one another when the actuating arm of the device is operated through wide excursions, and the other type of device includes those wherein the strings do not stay in tune relative to one another as the actuating arm is so operated. For the strings to stay in tune relative to one another means that if a chord is played, operating the actuating arm through a large excursion will change the pitch of all of the strings in such a way that the notes produced remain in harmony with one another.

For the type of tremolo device which stays in tune upon operation of the actuating arm, the stabilizing device of this invention can be used to adjust the pitches of the strings simultaneously to play on keys above or below the standard pitch, the standard pitch being the pitches to which the strings are tuned when the actuating arm is unrestrained and unoperated. For example, an "A" chord could be transposed down to "G" or up to "B" by merely changing the heighth adjustment of the actuating arm through the use of the stabilizer device of this invention.

The more common tremolo device is of the type wherein the strings acceptably stay in tune relative to one another over only a small range of changes in the position of the anchoring member, and the stabilizer of this invention is useful in holding the anchor member in a fixed position when the tremolo device is not in use to prevent changes in string tuning such as might occur when a string breaks or when the strings otherwise change in tension during a performance.

The stabilizer of the invention includes a holding part engageable with the actuating arm of the associated tremolo device which holding part is adjustable in heighth and angle to suit many different guitars and tremolo devices. Even instruments of the same model can require different adjustments of the holding member as various different strings which might be used with the guitars will place the actuation arm at different heights and angles to the top of the instrument at the standard string tuning.

Once a guitar has been adjusted to standard tuning and the stabilizer device adjusted to hold the actuating arm at the position corresponding this standard tuning it is desirable to maintain this setting of the stabilizer.

Known stabilizers have the disadvantage that they project a considerable distance above the top surface of the guitar body and therefore very often make it impossible for the guitar to be fitted into a standard carrying case. In some instances the stabilizers can be adjusted to reduce their heighth to permit the guitar to fit into a case, but this changes the desired setting of the actuating arm and requires the setting to be reestablished when the guitar is again taken from its case.

The general object of this invention is therefore to provide a tremolo arm stabilizer which avoids the above-mentioned problem.

In keeping with this object, a more detailed object is to provide a tremolo arm stabilizer wherein the main portion of the stabilizer can be easily removed from the guitar body to allow the guitar to be received in its customary case and can be easily reattached to the guitar body when the guitar is again taken from its case, with the stabilizer when its main portion is reattached to the guitar maintaining the same tremolo actuating arm setting as it had at the time of its removal from the guitar.

SUMMARY OF THE INVENTION

The invention resides in a tremolo arm stabilizer comprised of a main component and a retainer component which two components are releasably connectable to one another. The retainer component is adapted to be permanently or semi-permanently attached to the top surface of a guitar body and is of relatively low heighth. The main component includes a base slidably receivable in the retainer component, a moveable part projecting upwardly from the base and vertically moveable relative to the base, and an adjusting part carried by the base and engageable with the moveable part to adjust the heighth of the moveable part relative to the base, the upper end of the moveable part having a holding member releasably engageable with a generally horizontally extending portion of the actuating arm of the associated tremolo device.

The invention also resides in a spring between the retainer component and the main component exerting forces on said components tending to hold them in their connected positions.

DESCRIPTION OF THE PREFERRED EMBODIMENTS

Figure 2:
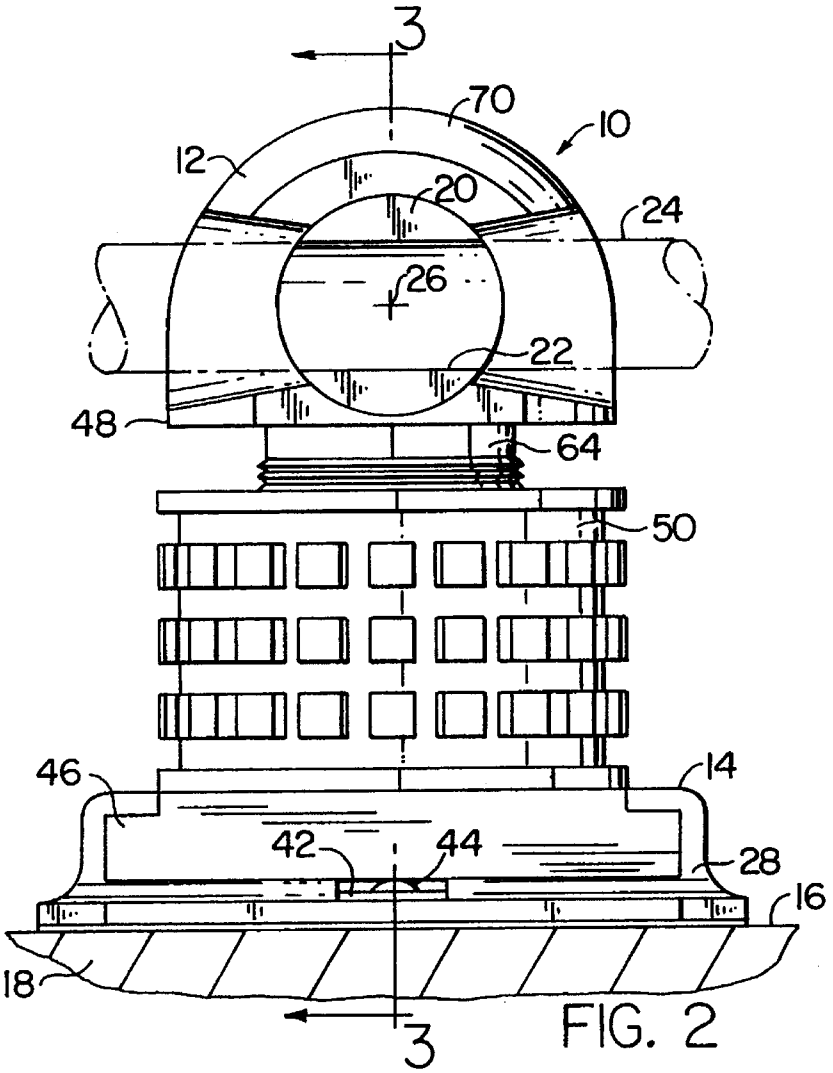
FIG. 2 is a front elevational view of the stabilizer of FIG. 1.
Figure 1:
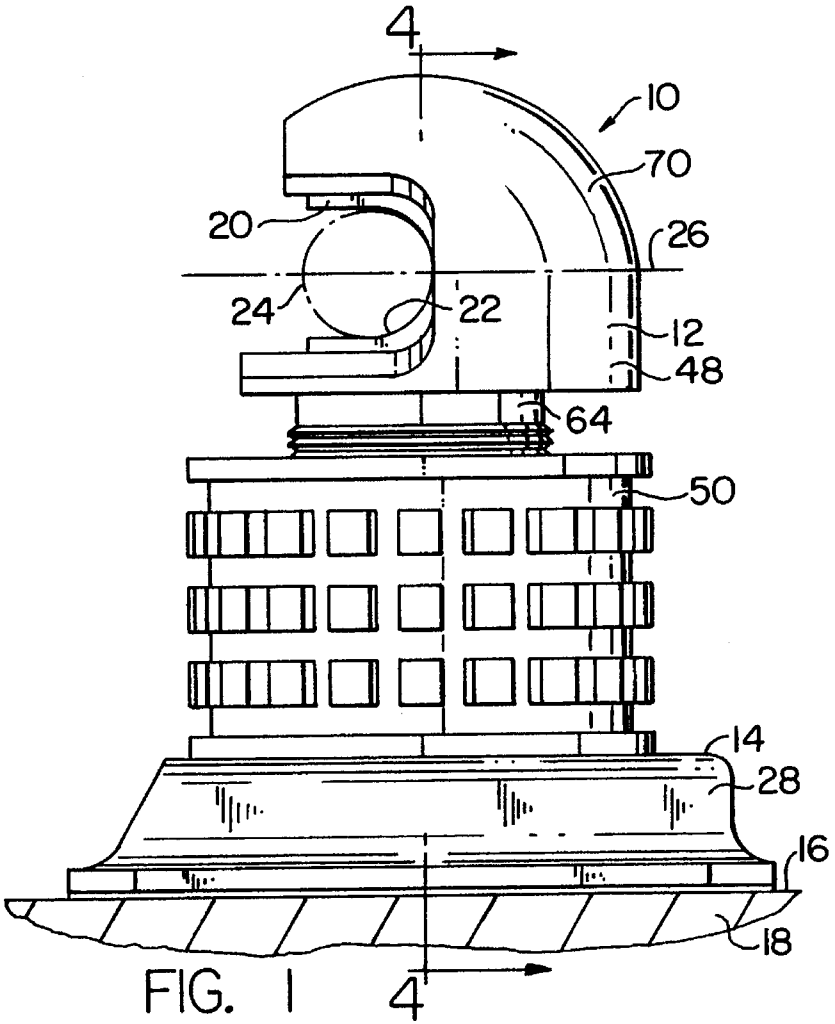
FIG. 1 is a side elevational view of a tremolo arm stabilizer embodying the present invention.

Referring first to FIGS. 1 and 2 a stabilizer embodying this invention is indicated generally at 10 and comprises a main component 12 and a retainer component 14. The retainer component 14 is adapted to be semi-permanently or permanently attached to the top surface 16 of a guitar body 18.

In the connected condition of the main component 12 and retainer component 14, as seen in FIGS. 1 and 2, the main component extends upwardly from the retainer component and at its upper end has a holding member 20 with a slot 22 for releasably receiving a portion of a tremolo arm, shown by the broken lines 24 which extends generally horizontally parallel to the top surface 16 of the guitar. As explained in more detail hereinafter the holding part 20 is adjustable in heighth relative to the top surface of the guitar body, and is also angularly adjustable about the horizontal axis 26, to hold the tremolo arm portion 24 at a desired heighth from the top surface 16 of the guitar and to suit the inclination of the arm portion 24.

Reference may now be had to FIGS. 3 to 7 for a more detailed explanation of the construction of the stabilizer 10. As shown by these figures the retainer component 14 is made primarily of a body 28 of molded plastic material. The body has a flat bottom surface 30 to match the flat upper surface 16 of the guitar body and can be semi-permanently or permanently fixed to the guitar body in various different ways. Preferably, however, it is attached to the guitar body through the use of a layer of double sided adhesive tape 32 interposed between the bottom surface 30 and the surface 16 to adhesively bond the retainer component to the guitar body.

Figure 5:
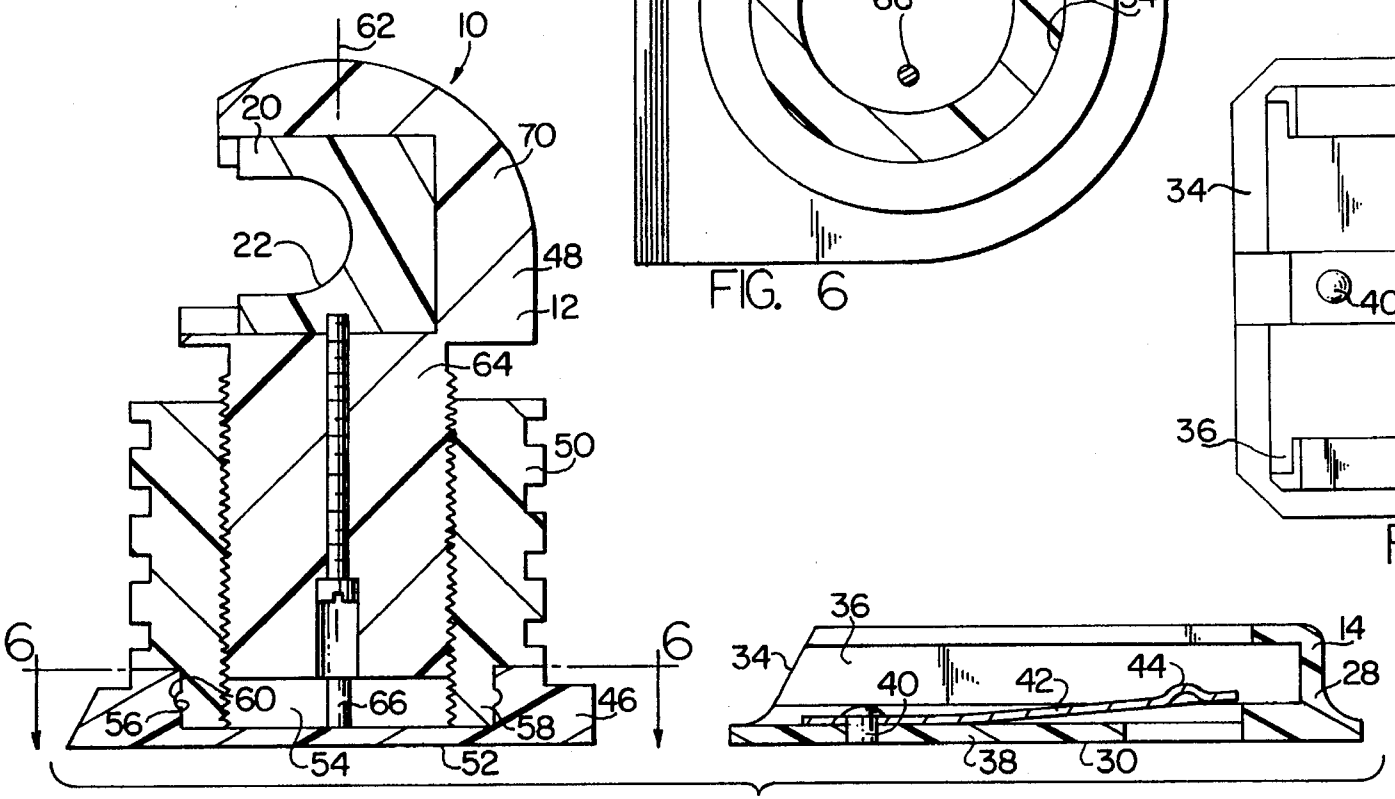
FIG. 5 is a view similar to FIG. 3 but showing the main component of the stabilizer removed from the retainer component.

The retainer body 28 has a front end 34 and is shaped to define a horizontally extending slot 36 extending inwardly from the front end 34 as seen in FIG. 5. The bottom wall 38 of the retainer housing 28 also has fixed to it, as by a rivet 40, a leaf spring 42 with a rounded protrusion 44 on its free end.

The main component 12 includes a base member 46, a moveable member 48 and a rotatable adjusting member in the form of a sleeve 50, all three of which parts are preferably made of plastic.

Figure 3:
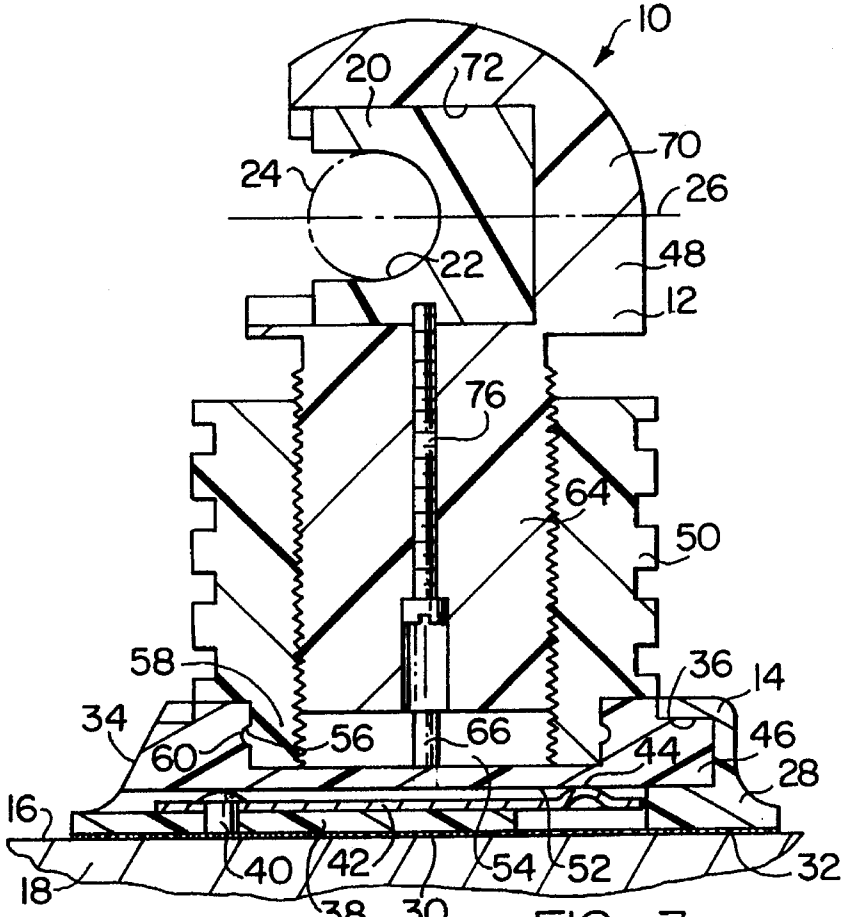
FIG. 3 is a vertical sectional view taken on the line 3—3 of FIG. 2.
Figure 7:
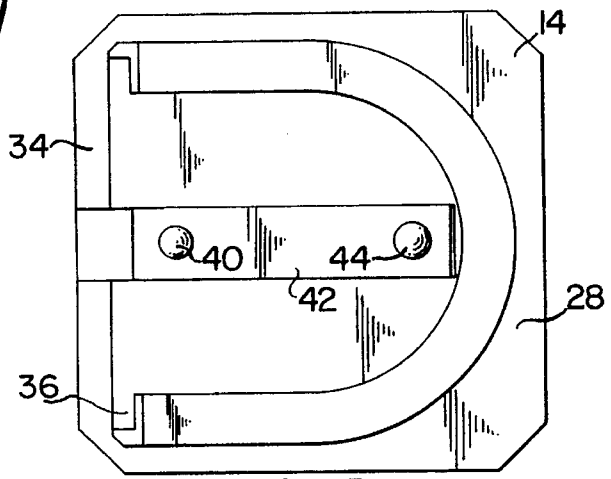
FIG. 7 is a top view of the retainer component of the stabilizer shown in FIG. 1.
Figure 6:
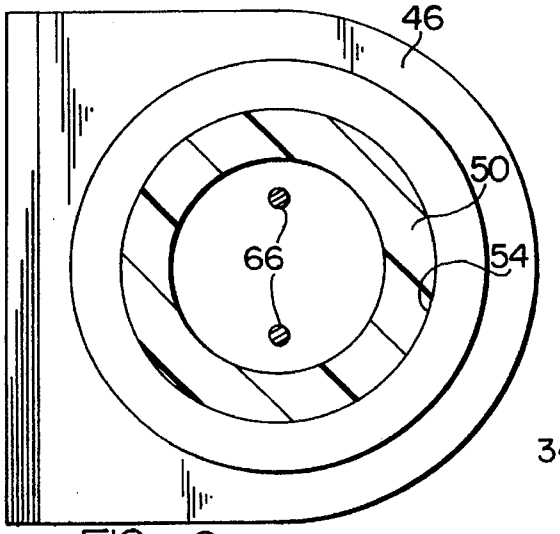
FIG. 6 is a horizontal sectional view taken on the line 6—6 of FIG. 5.

The base member 46 of the main component 12 is designed to be slidably receivable in the slot 36 of the retainer component 14 and can be slid into and out of the slot 36 between the connected position of FIG. 3 and the disconnected position of FIG. 5. When in the connected position of FIG. 3, the protrusion 44 of the leaf spring 42 frictionally engages the flat bottom surface 52 to aid in holding the components in their connected positions. However, the base 28 of the retainer component and the base member 46 of the main component are preferably so relatively dimensioned that the sliding fit between the two parts is a relatively snug one so that the two parts when assembled are frictionally held in assembly even without the assistance of the spring 42, with some slight manual force having to be applied between the parts to move them into and out of the connected condition.

As best seen in FIG. 5, the base member 46 of the main component 12 has an upwardly facing circular recess 54 with a circular groove 56 in its side wall. The annular sleeve 50 in turn has a cylindrical bottom portion 58 with a circular rib 60 received in the groove 56. The base member 46 and sleeve 50 are so relatively dimensioned that the two parts can be snap fitted relative to one another to bring them to the assembled condition of FIG. 5 whereat the sleeve 50 is held in place on the base part 46, by sliding co-engagement of the rib 60 with the groove 56, for rotation relative to the base member 46 about a vertical axis 62.

Figure 4:
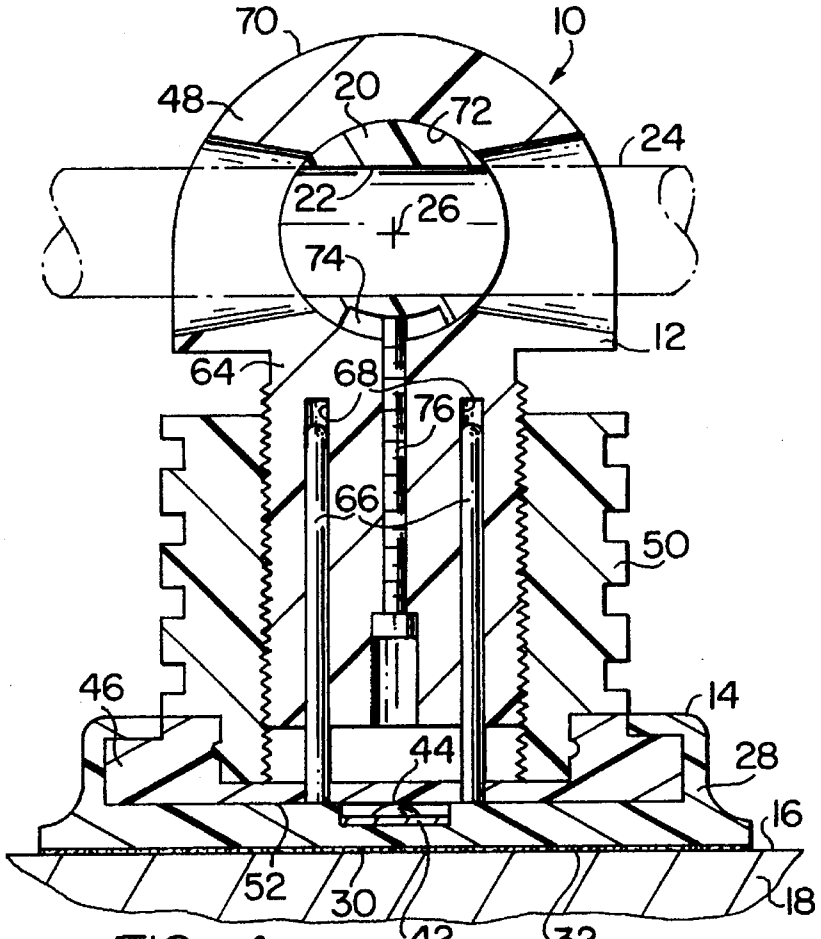
FIG. 4 is a vertical sectional view taken on the line 4—4 of FIG. 1.

The moveable part 48 of the main component 12 has a lower portion 64 threadably connected with the sleeve 50 as shown best in FIG. 5. Rotation of the moveable part 48 relative to the base member 46 about the vertical axis 62 is prevented by two guide pins 66, as best seen in FIG. 4, fixed to the base member 46 and slidably received in two complementary bores 68 in the bottom portion 64 of the moveable part 48. Therefore, it will be understood that by rotation of the sleeve 50 in one direction or the other about the vertical axis 62 the moveable part can be moved upwardly or downwardly relative to the base member 46 to adjust the heighth of the holding member 20 which is carried by the part 48.

The vertical moveable member 48 has a dome shaped head portion 70 which carries the holding member 20. As shown in FIGS. 3 and 4 the holding member is of generally cylindrical shape and is received in a complementary cylindrical recess 72 of the head portion 70 so as to be angularly moveable about the axis 26 relative to the head portion. On its lower side, as seen in FIG. 4, the holding member 20 includes an arcuate recess 74 receiving the upper end of a screw 76 threadably carried by the lower portion 64 of the vertical member 48. The screw 76 normally engages the bottom surface of the recess 74 to fix the angular position of the holding part 20 relative to the head portion 70, but the screw can be slightly unthreaded to permit angular adjustment of the holding part 20 about the axis 26, or can be unthreaded further to permit the removal of the illustrated holding part 20 for replacement of it by a similar part having a differently sized recess 22 to accommodate a tremolo actuating arm portion of different diameter.

We claim:

1. A tremolo actuating arm stabilizer, for use with a guitar having a body with a top surface and also having a tremolo device with an actuating arm having a portion extending generally horizontally parallel to said top surface and pivotal relative to said guitar body between active and inactive positions, said stabilizer being engaged with said generally horizontally extending actuating arm portion when said actuating arm portion is in said inactive position to hold said actuating arm portion against vertical movement relative to said guitar body and said stabilizer being disconnected from and out of engagement with said actuating arm portion when said actuating arm portion is in said active position to allow said actuating arm portion to be moved vertically by a player of said guitar, said stabilizer comprising:

a retainer component adapted for attachment to said top surface of said guitar body;

a main component including a base member; and a means releasably connecting said base member of said main component with said retainer component so that when said main component is connected with said retainer component said main component extends upwardly from said retainer component and upwardly from said top surface of said guitar;

said main component also including a movable component, cooperable means on said base member and on said movable component supporting said movable component for vertical movement relative to said base member over a given range of vertical positions of said movable component relative to said base member, and a manually operable adjustment means associated with said main component and with said base member for selectively setting the vertical position of said movable component relative to said base member, said movable member having a means engaged with said actuating arm portion of said tremolo device when said actuating arm portion is in said inactive position to hold said actuating arm portion at a fixed heighth from said retainer component which fixed heighth is dependent on the vertical position of said movable component relative to said base member as set by said adjustment means.

2. A tremolo actuating arm stabilizer as defined in claim 1 wherein said means releasably connecting said base member with said retainer component includes means defining a horizontally extending slot in said retainer component, and a part on said base member of said main component slidably movable in said slot.

3. A tremolo actuating arm stabilizer as defined in claim 1 wherein said retainer component includes a retainer body having a flat downwardly facing bottom surface, said retainer body having a front end and a slot extending horizontally inwardly from said front end, said base member of said main component having a shape complementary to that of said slot in said retainer body so as to be receivable in and slidably movable relative to said slot.

4. A tremolo actuating arm stabilizer as defined in claim 3 further characterized by said retainer component and said main component being movable relative to one another between a connected condition at which said main component is connected with said retainer component and a disconnected condition at which said main component is disconnected from said retainer component, and a leaf spring carried by said retainer body of said retainer component and having a portion engagable with said base member of said main component to tend to hold said retainer component and said main component in said connected condition.

* * * * *